United States Patent [19]

Kali

[11] 4,208,084

[45] Jun. 17, 1980

[54] CONNECTOR FOR ELECTRICAL STRIP CABLE

[76] Inventor: David I. Kali, 4312 E. Seventh St., Tucson, Ariz. 85711

[21] Appl. No.: 853,216

[22] Filed: Nov. 21, 1977

[51] Int. Cl.[2] ..... H01R 13/38

[52] U.S. Cl. ..... 339/98

[58] Field of Search ..... 339/95 D, 97 R, 97 P, 339/98, 99 R, 176 MF

[56] References Cited

U.S. PATENT DOCUMENTS

| | | | |
|---|---|---|---|
| 2,930,021 | 3/1960 | Hasselhorn et al. | 339/99 R |
| 3,189,863 | 6/1965 | Leach | 339/99 R |
| 3,201,745 | 8/1965 | Williams | 339/99 R |
| 3,573,713 | 4/1971 | Enright et al. | 339/98 |

FOREIGN PATENT DOCUMENTS

| | | | |
|---|---|---|---|
| 1962231 | 9/1970 | Fed. Rep. of Germany | 339/99 R |
| 2022662 | 11/1971 | Fed. Rep. of Germany | 339/95 D |
| 2535933 | 2/1976 | Fed. Rep. of Germany | 339/99 R |

*Primary Examiner*—Joseph H. McGlynn
*Attorney, Agent, or Firm*—J. Michael McClanahan

[57] ABSTRACT

A connector for a plurality of conductors in an electrical strip cable assembly having means for individually engaging each conductor of the strip cable assembly by automatically removing insulation to make electrical contact together with means to receive and engage electrical wires in order that electrical conduct may be made between the conductors of the strip cable assembly and the electrical wires. The connector comprises a base and a cover and individual wire contacts attached to the cover adapted to receive and hold electrical wire, whereby when pressing the cover and base into mating configuration, the contacts remove insulation from the conductors of the strip cable assembly to make electrical contact.

10 Claims, 13 Drawing Figures

CONNECTOR FOR ELECTRICAL STRIP CABLE

BACKGROUND OF THE INVENTION

There has been substantial activity in the field of electrical strip cable assemblies providing means to conduct electricity or electrical signals over relatively short distances as unobtrusively as possible. This has been used commonly in areas such as electrically interconnecting a loud speaker system to a phonograph or tape player in an entertainment type stereo system, to light an overhead picture, for use in doorbell-switch arrangement, or in security devices electrical interconnections.

The strip cable assembly comprises two parallel, thin, flat metal foil conductors laid upon the adhesive side of a single-sided adhesive coated tape insulative cover strip with a release strip covering the foil conductors and the remainder of the adhesive. The release strip is peeled from the cover strip and the tape is attached to an object. Commonly the electrical strip cable assembly is taped to a wall of a room and run between the home entertainment stereo system and the distal loud speakers. The strip cable assembly may then be painted over with the same color paint as was utilized on the room wall and the strip will be completely unnoticeable. The art in electrically conductive pressure sensitive adhesive tapes may be found in patents of Giellerup, U.S. Pat. No. 3,132,204; Richter, U.S. Pat. No. 3,168,617; and Wolf, U.S. Pat. No. 3,763,307.

As is obvious, there exists a need to remove the electrical energy or information from the electrical strip cable assembly. For example, the strip cable assembly must connect to the home entertainment stereo system output or perhaps, an electrical transformer output where electrical energy is desired to be supplied the line, both of which require connection with electrical wires. Further, it is obvious that you must remove the electrical energy or electrical signals from the tape strip cable assembly at the point where the loud speakers are located or, if the system is used in the doorbell type configuration, at the doorbell or at the push button switch.

Now there have been connectors adapted to remove electrical signals or energy from the tape strips, for example the Wolf Patent above and another Wolf Patent, namely, U.S. Pat. No. 3,524,921. However, the connectors which are presently known and available for the transistion from the tape strip assembly to an electrical wire type conductor are bulky, expensive, and require a great deal of time in preparing and attaching the connector to the strip cable assembly, or in addition, requiring the cable be terminated at the connector. Nor may the available connectors be easily removed from the strip cable assembly when it is no longer needed.

Accordingly, there exists a need for a connector which may be attached to the strip cable assembly with a minimum of time and effort whereby electrical power or signals may be removed from the strip cable assembly.

SUMMARY OF THE INVENTION

The present invention contemplates a connector for an electrical strip cable assembly having two generally thin planar components, a base component being channel shaped with two lengthwise side walls, the formed interior channel adopted to receive the insulated electrical strip cable assembly having a plurality of thin, flat, metal foil electrical conductors attached thereto in parallel, non-touching arrangement. The second planar component comprises a cover assembly adapted to mate with the base component in parallel fixed configuration, there being protruding lengthwise tab means extending from opposite sides of the cover, the tab means generally overlapping and meshing in a groove of the base lengthwise side walls. Interiorly to the flat planar portion of the cover are a plurality of rectangular spring metal means having their opposite ends bent down away from its center, the ends of the contacts adapted to contact the flat strip cable electrical conductor members by having the ends of the bent metal contacts engaging the insulative cover over the flat strip cable electrical conductors in the process of mating the cover and the base, and thereby scraping away the insulative cover and thus making electrical contact with the conductor. Electrical wire means are inserted in a sized lengthwise channel central to a second channel in the cover engaging the metal contacts, the electrical wire means touching the rectangular metal contacts. The electrical wires are held in continual touching arrangement by triangular shaped tangs which protrude upward from the metal contacts, pressing against the electrical wire and resisting backward removal of the wire.

The inventive flat connector provides a small, unobtrusive, easily placeable means by which electrical wire connection may be made to a flat strip cable assembly in a tapping or terminating arrangement.

It is an object of the present invention to provide a small, unobtrusive, flat connector which may be attached to strip cable assembly with a minimum of time and effort to facilitate removal of electrical power or signals.

Another object of the present invention is to provide a connector for a strip wire cable assembly which may be placed at any place along the strip wire cable assembly and which connector does not terminate the strip wire cable assembly and which may be removed as desired.

It is still further an object of the present invention to provide a connector for a strip wire cable assembly which permits a plurality of wire connections to each of a plurality of electrical conductive strips on the strip cable assembly.

DETAILED DESCRIPTION OF THE PREFERRED EMBODIMENT

Figure 1:
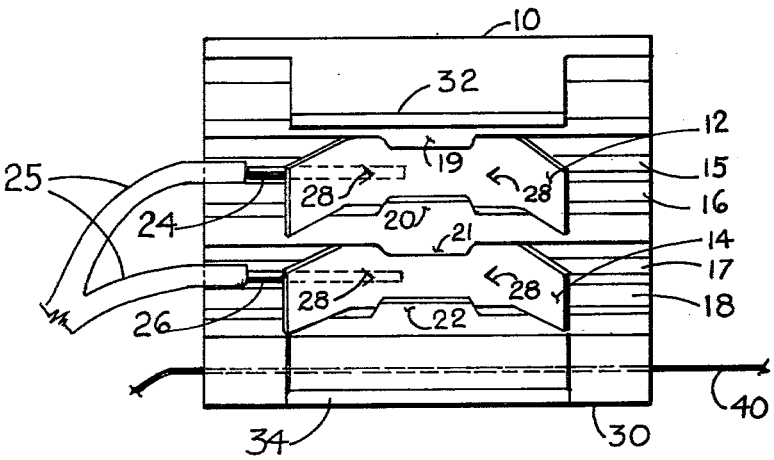
FIG. 1 is a front view of the inventive connector shown in a position just prior to final assembly.
Figure 2:
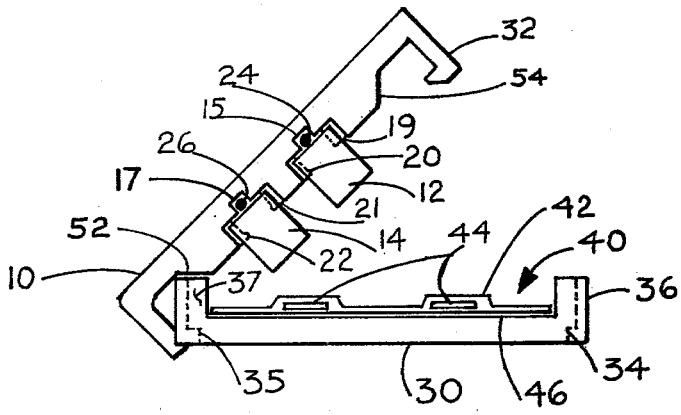
FIG. 2 is an end view of the inventive connector shown just prior to final assembly.

Referring now to FIGS. 1 and 2, a front view of the partially assembled connector in position ready to assemble the cover and the base together and an end view of the partially assembled connector respectively, it may be seen that the cover 10 is perched at an angle of about 60° (FIG. 2) from base 30 for convenience, the cover and base engaging each other on one side preliminary to placing the cover into a final secured configuration with base 30, final assembly being accomplished by finger pressure. Attached to cover 10 are the plurality of metal contacts 12 and 14, each of which have their ends bent from the central portion of the contact and which contacts are secured in place in lengthwise channels 16 and 18 by means of holding protrusions 19 and 20 and 21 and 22 respectively, which protrude from the channel walls.

Central to lengthwise channels 16 and 18 are lengthwise grooves 15 and 17 respectively which serve the purpose to provide a place of residence for the electrical wire 24 and 26 respectively which are pushed into the grooves to make firm electrical connection with contacts 12 and 14 respectively. Punched through contacts 12 and 14 are triangular shaped projection louvers or tangs 28 which provide a sharp point above the flat surface of the contacts, which sharp point engages electrical wires 24 and 26, respectively, and resists attempts to pull the electrical wire out of its engagement position between the contacts and their respective grooves. The electrical wires shown as 24 and 26 are bare wires that have been stripped of their insulation 25, and preferably, in the case of multi-conductor wire, the electrical wire ends have been tinned with solder.

Additionally shown in FIG. 1 is cover 10 protruding tab 32 which engages undercut notch 34 of base 30 when the cover is pressed down to fully engage base 30.

Additionally shown in FIG. 1 is the electrical cable assembly 40 which contains, in this particular case, two parallel, thin, flat, strips of electrical metal foil conductors attached to the adhesive side of an adhesive coated tape cover strip. The flat parallel thin strips of conductor are covered with the release strip, which has been removed proximate base 30 for adhering to base 30.

In operation, the inventive device is prepared by removing a portion of the release strip or other protective cover attached to the bottom part of the electrical strip cable, the portion removed conforming generally to the length of the base 30, and sticking the adhesive backed electrical strip cable in the channel formed in base 30 (FIG. 2). The electrical contacts 12 and 14 are already attached to cover 10, being held in place against the bottom of their respective channels by protrusions 19 through 22. Contacts 12 and 14, which are set out separately in a later figure, are somewhat barbell shaped, having their central section firmly engaged by the protrusions shown. Electrical wires 24 and 26, preferably after being tinned, are each individually inserted under their respective contacts and pushed forward by hand until they are firmly engaged in their groove under the contact, tang 28 resisting their effort to be pulled out. Cover 10, which has had its tab opposite tab 32 engaged with the undercut notch on base 30 (FIG. 2), is then pushed down upon the base 30 until tab 32 completely engages undercut notch 34. At this point, the protruding ends of contacts 12 and 14 (both ends of each contact) engage the upper insulation cover upon strip cable assembly 40 and, as cover 10 fully goes to its final position with its top parallel to base 30, the flat square ends of the contacts 12 and 14 scrape off the cover and make electrical contact with the parallel thin strips of conductor. Cover 10 is now held in a fixed secure permanent position to base 30 which may only be removed by engaging tab 32 from the underside of base 30, pushing it out beyond the side of base 30, and raising cover 10 to clear. It is noted that the cover 10 and the base 30 are symmetrical about a lengthwise center line and either side along the length may serve as the pivoting hinge and the resulting locking side, although it should be noted, both side lock.

Referring now primarily to FIG. 2, an end view of the inventive connector, base 30 is shown with the attached electrical strip cable 40, the electrical insulative cover 42, and the flat, parallel, thin electrical conductors 44. As indicated before, the strip cable 40 comprises a single-sided adhesive coated cover strip of tape 42 (from which the release strip protective cover has been removed) and is stuck to the bottom channel or trough of base 30. In place is cover 10 which comprises one piece, having tab 32 to engage undercut notch 34 of base 30 (shown in dotted form). Better shown in FIG. 2 are grooves 15 and 17 centrally located to channels 16 and 18 respectively, grooves 15 and 17 adopted to and as shown in FIG. 2, containing wires 24 and 26.

As can be seen in FIG. 2 by the shape of tab 32 attached to cover 10, and in particular, the lip cut underportion of tab 32 engaging undercut notch 35 of base 30, in combination with beveled edge 52 formed in cover 10, cover 10 is held in an upright position. As explained earlier, either side of the assembly may be worked as the hinge portion as both base and cover are lengthwise symmetrical about a center line.

In operation and when making final connection, the cover 10 is pushed down upon base 30 which, from the position shown in FIG. 2, urges the contacts horizontally over as beveled edge 52 is slipped off the upright wall of base 30, and aligning contacts 12 and 14 with electrical conductor strips 44. As earlier explained, contacts 12 and 14 engage electrical insulative cover 42, stripping away the insulation and making electrical contact with conductors 44. Tab 32 of cover 10 engages and is secured under undercut notch 34 of base 30. In the preferred embodiment, both the cover 10 and the base 30 are single pieces made from extruded plastic material.

Figure 3:
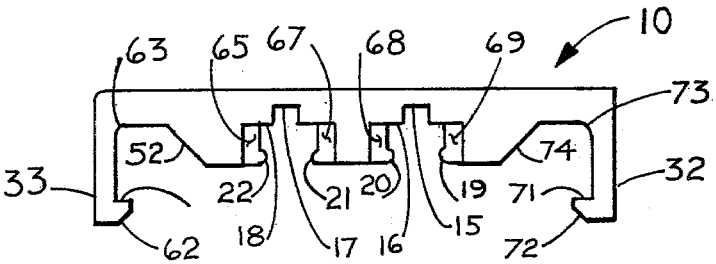
FIG. 3 is an end view of the cover assembly.
Figure 4:
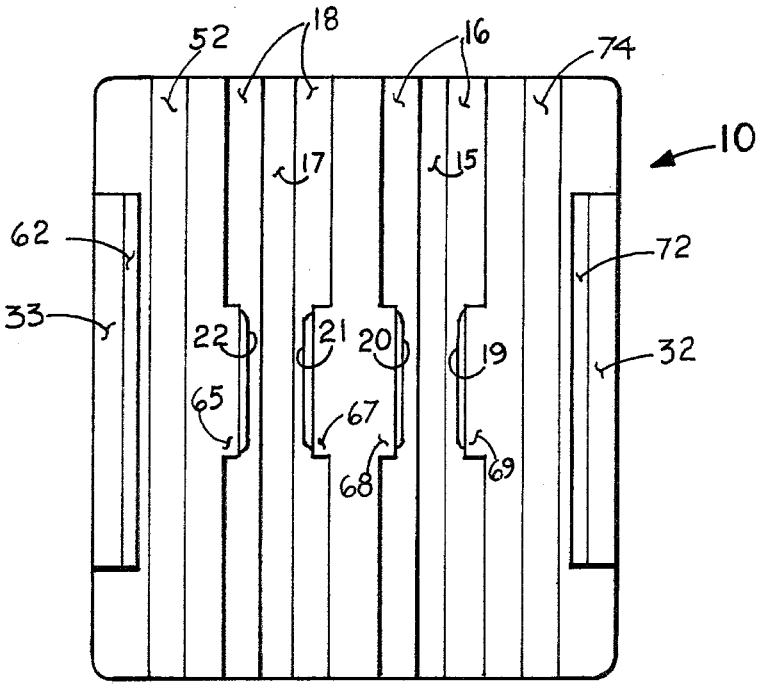
FIG. 4 is a view looking up at the bottom of the cover assembly.

Referring now to FIGS. 3 and 4, an end view and view from below looking up respectively, is shown of cover 10. Proceeding from left to right on both Figures, tab 33, an elongated upright wall protruding from the primary planar shaped piece is shown with its lip 61 for engaging undercut notch 35 of base 30 (FIGS. 5 and 6), rounded corner 63 for easy rolling over upright walls of base 30 (FIG. 5) and beveled edge 52 which sits on the top of wall 37 on base 30 (FIG. 2) in the partially assembled position. Continuing on, channel 18 in cover 10 is shown bisected by groove 17 running lengthwise through the center of channel 18; and contact engaging protrusions 22 and 21 eminating from wall constrictures 65 and 67 which serve, along with protrusions 22 and 21, to hold the contacts and to align same. Continuing on, the same configuration in and around channel 16 is shown adjacent to channel 18 having lengthwise therethrough in bisecting manner, groove 15, protrusions 20 and 19 as well as contact holders 68 and 69. Continuing in the description of the end view of cover 10, rounded corner 73 continues the planar portion of cover 10 into the downward extending tab 32 with lip 71 emerging perpendicular to tab 32 adapted for engaging undercut notch 34 of base 30 (FIG. 2). Beveled edges 74 and 72 correspond with their mirror image, beveled edges 52 and 61 respectively.

Figure 7:
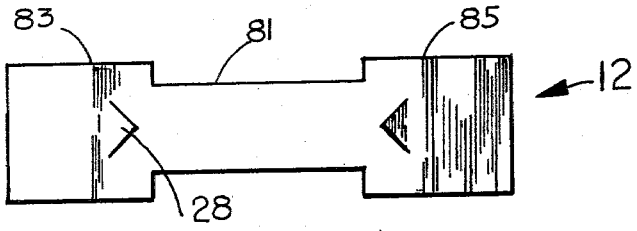
FIG. 7 is a top view of the spring metal electrical contacts.

In FIG. 4, the view of cover 10 looking up from below, tabs 33 and 32 extend centrally from mid positions on opposite sides of the planar portion of the cover 10, each having their beveled surface 62 and 72 respectively. Continuing inwardly from both sides, beveled edge surfaces 52 and 74 are shown by lines where the surfaces abruptly change. Channels 18 and 16 are shown with grooves 17 and 15 respectively lengthwise bisecting the slideway. Central to channel 18 are contact holders 65 and 67 which extend inwardly from the walls forming the sides of channel 18 and from which, in turn, extend protrusions 22 and 21. The purpose of the contact holders, as indicated by their name, is to hold and align the contacts at their central reduced width portion (FIG. 7). The contacts are pushed down into channel 18 over protrusions 22 and 21 to a position below. Similarly as with channel 18, channel 16 contains contact holders 68 and 69 which also have protrusions 20 and 19 therefrom, also for the purpose of holding the contact shown in FIGS. 7 and 8.

Figure 5:
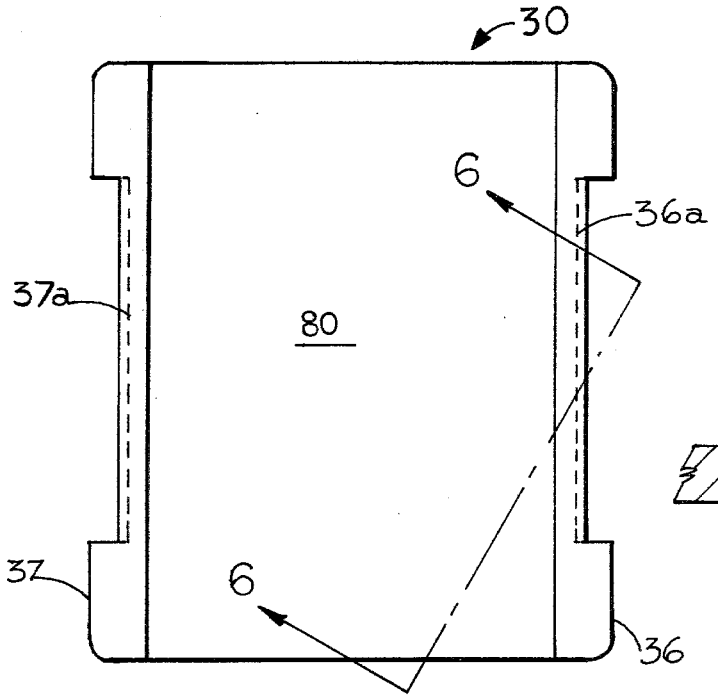
FIG. 5 is a top view of the base assembly.

Proceeding on, the base 30 is shown in top view in FIG. 5 comprising basically planar surface 80 with two parallel walls along opposite sides. More specifically, walls 36 and 37 extend lengthwise, the walls being narrowed in each of their central portions. It is noted that the length of the narrowed wall central portion is slightly longer than the length of tabs 32 and 33 of cover 10. Shown dotted in the narrowed central portion are undercut notches 34 and 35 arranged to be engaged by lips 61 and 71 of cover 10 (FIG. 3).

Figure 6:
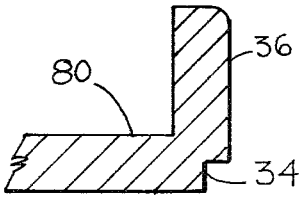
FIG. 6 is a sectional view of the base assembly taken along sectional lines 6—6.

As can be seen from FIG. 6, a cross-sectional view taken at sectional line 6—6 in FIG. 5, wall 36 is shown extending upright from the base of planar portion 80, the view being shown in FIG. 6 of wall 36 is that through the central portion where the wall thickness has been reduced. The roll-over edge of the upper central portion of wall 36 is shown as is undercut notch 34 adopted to be engaged by lip 71 of cover tab 32.

As it can be seen by combining the cover shown in FIGS. 3 and 4 with the base shown in FIGS. 5 and 6, tabs 32 and 33 of cover 10 engage the thin central portion of walls 36 and 37, tabs 32 and 33 nesting within the cutout portion of walls 36 and 37 such that when the cover 10 is fully engaged with base 30, a generally straight and solid side is presented along the wall portions 36 and 37.

Referring now to FIG. 7, the contacts 12 and 14 are shown. View 7 is a top view of the generally rectangular shaped contact showing its narrowed center section 81 and each of the extending arms 83 and 85. Central to contact 12 is projecting tang 28 which, as earlier stated is triangular shaped formed by having a "V" punched through the contact metal to reveal the sharp point.

Figure 8:
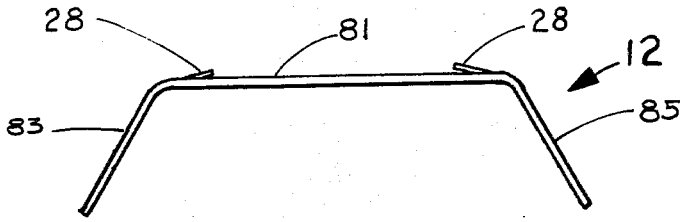
FIG. 8 is a side view of the spring metal electrical contacts.

FIG. 8 is a side view of contact 12 showing the ends of contact bent down to apply force against the flat electrical strip cable, scrapping off the upper insulation as the cover is closed in order to make electrical connection with the flat wire conductors attached to the tape. Thus it is important the ends of the contact be square, i.e., 90° edges, and not rounded, in order to scrape off the insulation. Seen in the side view are upward projecting tangs 28 which engage wires that are inserted into the grooves of the channels. Note that wire enters from both sides. The angle at which the arms 83 and 85 make with the narrowed horizontal center section 81 has been best found to be about 120°, although there can be a range of as much as 30° to 150°. This of course, anticipates the angle shown to be an acute angle rather than obtuse.

It has been determined that the type of material utilized in the contacts best be spring steel which has been cadmium plated, or a berylium-copper alloy. With this construction, it has been found that the contact retains its original shape after repeated use and continues to exert pressure against the thin wires of the electrical strip cable to ensure sufficient electrical contact when in use.

The invention, in operation, presents a small, flat, and thin connector by which a transition between a flat tape type electrical conductor to individual wire type electrical conductors. Two or more wires may be entered from each side of the contacts providing many electrical connections. It is realized of course that the invention is not limited to two electrical connections and their wires, but also applies to a connector for more electrical connections.

Figure 9:
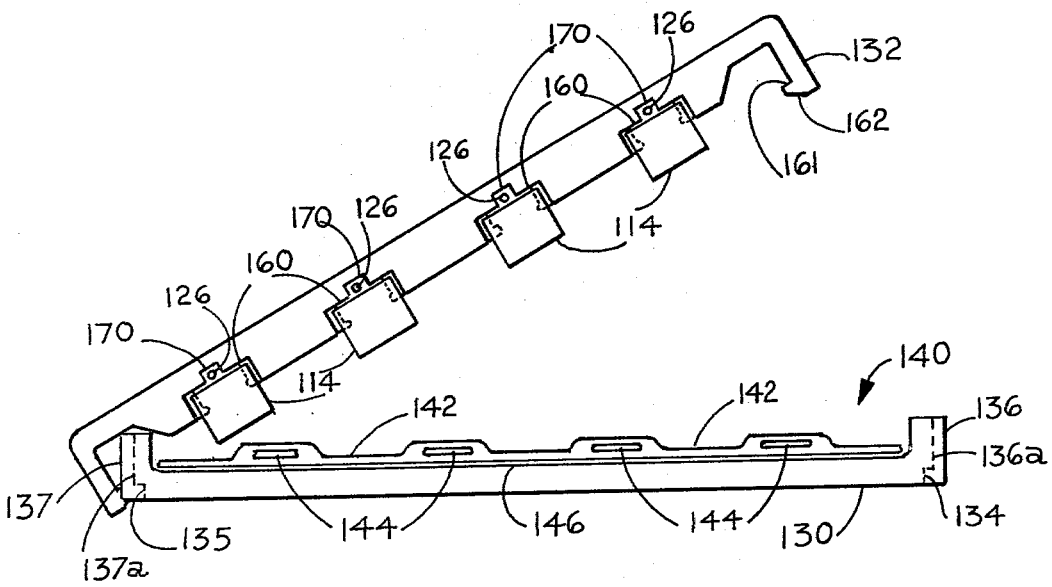
FIG. 9 is an end view of a four-conductor connector.

For example, referring specifically to FIG. 9, an alternate embodiment of the invention is shown where provisions have been made for four conductors in a flat strip cable assembly 140. The four conductors 144 are shown covered with the electrical insulation cover strip 142, which when the release strip is removed, attaches to the base 130 bottom surface. Running lengthwise are the undercut notches 134 and 135 shown in dotted form on either side of the base section. The reduced portion of the walls 136 and 137 are shown in dotted form as 136A and 137A.

Again the cover 100 is shown angled to base 130 with the four contacts 114 in their respective channels 160 with interior lengthwise grooves 170 and wires 126 interior thereto. Contacts 114 are held in the channels 160 similarly as was described in FIGS. 1 and 2, there being contact holders with protrusions attached thereto extending inwardly from the sides of the channel (dotted). On opposite lengthwise sides of cover 100 are tabs 132, each being a mirror image of the other which, like the cover for two conductors shown in FIG. 3, have corresponding lips 161 and beveled surface 162 to slip by the indented wall portion 136A of the base 130 and catch undercut notch 134 of base 130.

All other aspects of the invention remain the same, that all that has been accomplished is to extend the width of the connector to accommodate more contacts for use in strip wire assemblies with more conductors.

Figure 13:
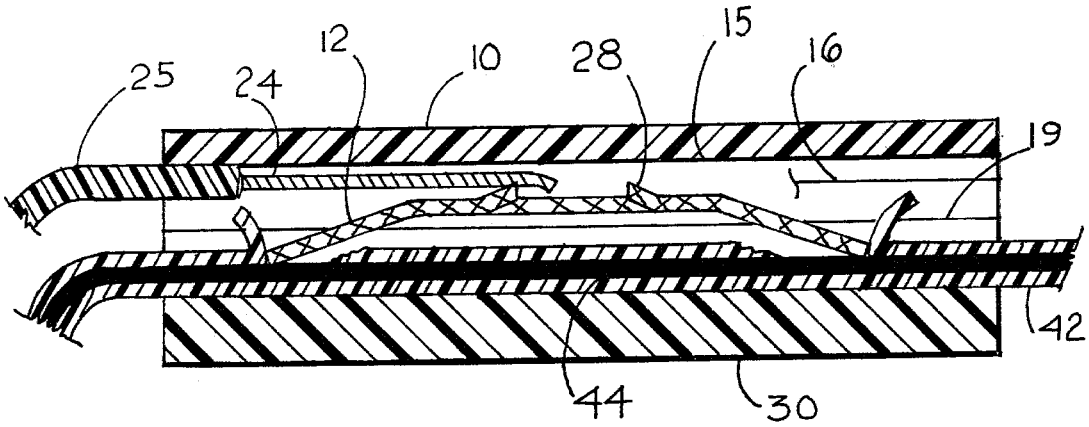
FIG. 13 is a sectional view of the cover and base in a mating condition taken along the center of the electrical contact.

Referring now to FIG. 13, a cross-sectional view of the inventive connector for electrical strip cable is detailed in its closed mated condition. The corss-sectional view is taken along the lengthwise center of the longitudinal channel 15, which by doing so, illustrates all the elements which make the electrical connection between the electrical wire 25 and the inner electrical conductor 44 of the insulated strip cable assembly. More specifically it can be seen that the electrical contact 12, which was bent down at each end, has almost achieved a flattened condition, and that the right angle edge on each end of electrical contact 12 has scraped away insulation 42 on top of electrical conductor 44 situated in the electrical strip cable, and thereby made electrical connection with inner conductor 44. Here, electrical wire 25 conductor 24 is engaged by the pointed louvers or upward projecting tang 28 which engages electrical wire 24 and prevents electrical wire 24 from being removed by pulling on the wire itself. In the background is the partial line representing the bottom of channel 15, the lower portion of its wall 16, and the lengthwise primary channel 19 which provides the protrusions (not shown) which hold electrical contact 12 in place.

Thus, it can be seen that as the cover 10 is brought down over the base 30, the bent over end tabs of contact 12 are urged against the upper insulation 42 of the electrical strip cable, the square end edges of contact 12 engaging and scraping the insulation 42 away and making contact with the inner conductor 44 therein. The insulation which has been scraped away is shown bending back from the end resting point of the electrical contact 12 bent over tabs.

Figure 10:
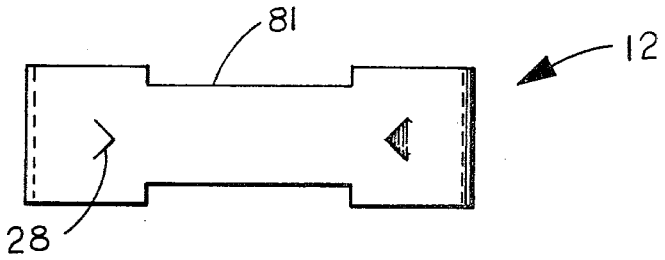
FIGS. 10, 11, and 12 are the top view, the front view, and the end view respectively of an alternate embodiment of the electrical contact.
Figure 11:
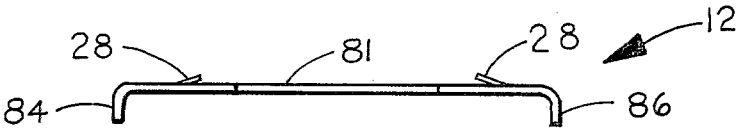
Figure 12:
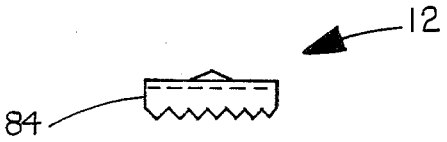

Another embodiment suggested by the preferred embodiment is shown in FIGS. 10 through 12 where contact 12 has been modified in its end tab portions to include end tab 84 and 86 having saw-tooth edges. The central portion 81 which fixes to the cover 10 remains the same as do tangs 28. Shown in FIG. 11 is a side view of the inventive contact and FIG. 12 shows an end view of tab 84 illustrating the saw-tooth edge.

As is obvious from the mode of construction, the shortened end tab 84 and 86 engage the strip cable assembly insulative cover and the teeth at the ends thereof penetrate the insulative cover and make electrical connection with the metal conductors thereunder.

While a preferred embodiment and two alternate embodiments of the invention have been shown and described, it is appreciated that the invention is not to be limited except as described in the foregoing claims.

I claim:

1. A connector for making electrical connection between an electrical wire and an electrical conductor within an insulated electrical strip cable assembly comprising a cover; an electrical contact operably connected to said cover; and a base adapted to receive said cover in mating relationship; said cover including means to receive an associated electrical wire, and said electrical contact including a protruding pointed louver to engage and hold the associated electrical wire, both said cover electrical wire receiving means and said electrical contact pointed louver co-acting to receive, engage, and hold the associated electrical wire; said base also adapted to receive an associated strip cable assembly between said mated cover and base; said electrical contact also defining a flexible elongated square cornered metal strip, said metal strip having a bend therein proximate one end, said one end having a right angle edge, said right angle edge adapted to engage and scrape away the associated strip cable assembly insulation to make electrical connection with the associated conductor whereby electrical connection may be made between the associated strip cable assembly and the electrical contact to the associated electrical wire when the flexible electrical contact turned down end scrapes away insulation of strip cable assembly as the cover and the base are mated.

2. The connector for strip cable assembly as defined in claim 1 wherein said electrical contact comprises two bent ends on opposite ends of said electrical contact.

3. The connector for strip cable assembly as defined in claim 1 wherein said electrical contact comprises a plurality of electrical contacts.

4. The connector for strip cable assembly as defined in claim 1 wherein the bent end of said electrical contact is turned down at an angle of 120°.

5. The connector for strip cable assemly as defined in claim 4 wherein said bent end angle with said electrical contact is in the range of 30° to 150°.

6. The connector for strip cable assembly as defined in claim 1 wherein said cover comprises means to hold said electrical contact means in fixed alignment and means to engage said base means in mating configuration.

7. The connector for strip cable assembly as defined in claim 6 wherein said cover holding said electrical contact in fixed alignment comprises lengthwise channel means formed in said cover, said channel means having constrictions therein and said constrictions engaging said contact in holding fashion.

8. The connector for strip cable assembly as defined in claim 6 wherein said means to engage said base means in mating configuration comprises lip means.

9. The connector for strip cable assembly as defined in claim 8 wherein said base comprises a flat surface having parallel lengthwise notches along the underside thereof whereby said cover lip means engages said base notches to secure said cover and base in mating configuration.

10. A connector for making electrical connection between an electrical wire and an electrical conductor within an insulated electrical strip cable assembly comprising cover means, said cover means defining a first lengthwise channel means having constrictions therein, and a second channel means lengthwise interiorly to said first channel means; electrical contact means operably connected to said cover means first channel means, said electrical contact means held in said first channel means by said constrictions therein, said electrical contact means additionally including tang means proximate said second channel means, said tang means adapted to engage and retain an associated connective electrical wire in said second channel means, said contact means also including a down-turned end, said end having a right angle edge thereon adapted to engage and scrape away insulation from the associated strip cable assembly; and base means, said base means adapted to mate with said cover means, said base means additionally adapted to receive the associated electrical strip cable assembly whereby when said electrical strip cable assembly is situated in said base means and said base means and cover means are in mating configuration, said contact means end tab means engages and scrapes away the insulation on the associated electrical strip cable thereby making electrical connection between the associated strip cable assembly and the associated connective electrical wire.

* * * * *